United States Patent [19]

Duble

[11] 4,149,047

[45] Apr. 10, 1979

[54] CONTACTOR HAVING INTERLOCK FOR MOVABLE CONTACT CARRIER

[75] Inventor: Gerald R. Duble, New Windsor, Md.

[73] Assignee: Gould Inc., Rolling Meadows, Ill.

[21] Appl. No.: 803,950

[22] Filed: Jun. 6, 1977

[51] Int. Cl.[2] ..... H01H 9/20

[52] U.S. Cl. ..... 200/50 A; 335/158

[58] Field of Search ..... 200/50 A; 335/132, 157, 335/158, 165, 166, 168

[56] References Cited

U.S. PATENT DOCUMENTS

| | | | |
|---|---|---|---|
| 3,243,535 | 3/1966 | Platz et al. | 335/158 X |
| 3,324,431 | 6/1967 | Cataldo et al. | 335/132 |
| 3,781,728 | 12/1973 | Grunert et al. | 200/50 A X |
| 4,071,722 | 1/1978 | Hart | 200/50 A |

*Primary Examiner*—James R. Scott

*Attorney, Agent, or Firm*—Ostrolenk, Faber, Gerb & Soffen

[57] ABSTRACT

An electromagnetic contactor having a removable cover in front of its contact area is provided with a molded plastic interlock member biased by a torsion spring toward a blocking position in the path of the movable contact carrier. In this position of the interlock member the latter prevents closing of the contactor. However, when the cover is secured in its closed position, engaged complementary inclined cam formations on the cover and interlock member hold the latter in a position remote from the movable contact carrier thereby permitting the contactor to be closed.

5 Claims, 5 Drawing Figures

CONTACTOR HAVING INTERLOCK FOR MOVABLE CONTACT CARRIER

BACKGROUND OF THE INVENTION

This invention relates to interlock means for preventing closing of a contactor when the contact area cover is removed. Most particularly, the instant invention is an improvement over the switch interlock means described in the E. T. Platz et al U.S. Pat. No. 3,243,535 issued Mar. 29, 1966 for a Contactor Cover Interlock.

U.S. Pat. No. 3,324,431 issued June 6, 1967 for an Electromagnetic Contactor Having Interchangeable Auxiliary Devices, with J. B. Cataldo et al as inventors, describes a mutliphase contactor which, with only minor modification, may be provided with interlock means to prevent contact closing when the contact cover is removed. The contactor of the aforesaid U.S. Pat. No. 3,324,431 includes cooperating stationary and movable contacts, a carrier for the movable contacts, a magnetic operating means for operating the cooperating contacts into engagement, and a removable contact area cover. It has been found desirable, and often necessary, to prevent contact closing unless the cover is in fully closed position.

SUMMARY OF THE INVENTION

This is conveniently accomplished pursuant to this invention by providing an interlock member pivoted on the contactor frame and biased toward position to interfere with the contact carrier. When the cover is open the interlock member automatically moves to this blocking position to prevent contact closing. Closing of the cover cams the interlock member clear of the contact carrier to permit closing of the contacts.

Accordingly, a primary object of this instant invention is to provide novel means to prevent closing of a contactor when its contact area is uncovered.

Another object is to provide means of this type including a pivoted member which is biased to position for interfering with the movable contact carrier.

Still another object is to provide interlock means of this type that is relatively compact and simple to operate.

These as well as other objects of this invention will become readily apparent after reading the following description of the accompanying drawings in which:

BRIEF DESCRIPGION OF THE DRAWINGS

DESCRIPTION OF THE PREFERRED EMBODIMENT

Now referring to the Figures Contactor 10 is provided with a contact structure, contact operating mechanism, contact support means and contact cover means as described in the aforesaid U.S. Pat. No. 3,243,535.

Figure 2:
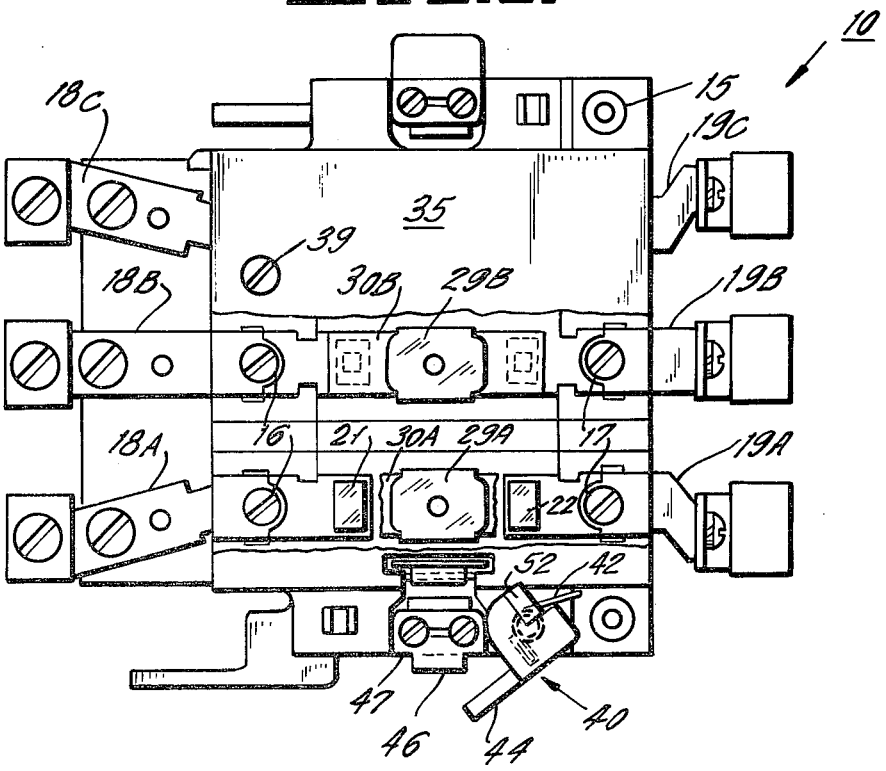
FIG. 2 is a plan or front view of the contactor of FIG. 1 with portions of the cover broken away to reveal elements of the contact structure.

Briefly, contactor 10 includes molded base 11 wherein electromagnetic contact operating means (not shown) is disposed with the operating coil of the latter having its terminals 12, 13 disposed externally of base 11. Stationary contact support plate 14, carrying guide studs 15, 15, is mounted at the upper end of base 11 by means of screws 16, 17 which engage line and load terminals 18, 19, respectively. In FIG. 2 the line terminals of the different poles are designated 18A, 18B and 18C while the load terminals are designated 19A, 19B and 19C. Screws 16 electrically connect individual stationary contacts 21 to each line terminal 18 while screws 17 electrically connect individual stationary contacts 22 to each load terminal 19. Stationary contacts 21, 22 are mounted on the top side of support plate 14.

Movable contact carrier 23 is mounted below support plate 14 for reciprocating movement guided by studs 15. Downward or rearward movement of carrier 23 and movable contacts thereon is caused by the actuation of the operating coil connected across terminals 12, 13 while upward movement is caused by biasing springs 26, coiled about each stud 15, when the operating coil is deenergized.

Clips 29A, 29B mount bridging contacts 30A, 30B, respectively, to the upper ends of extensions, from carrier 23, which project through apertures in support plate 14. Naturally, the third pole is provided with a bridging contact 30C (not shown) similarly mounted.

Figure 1:
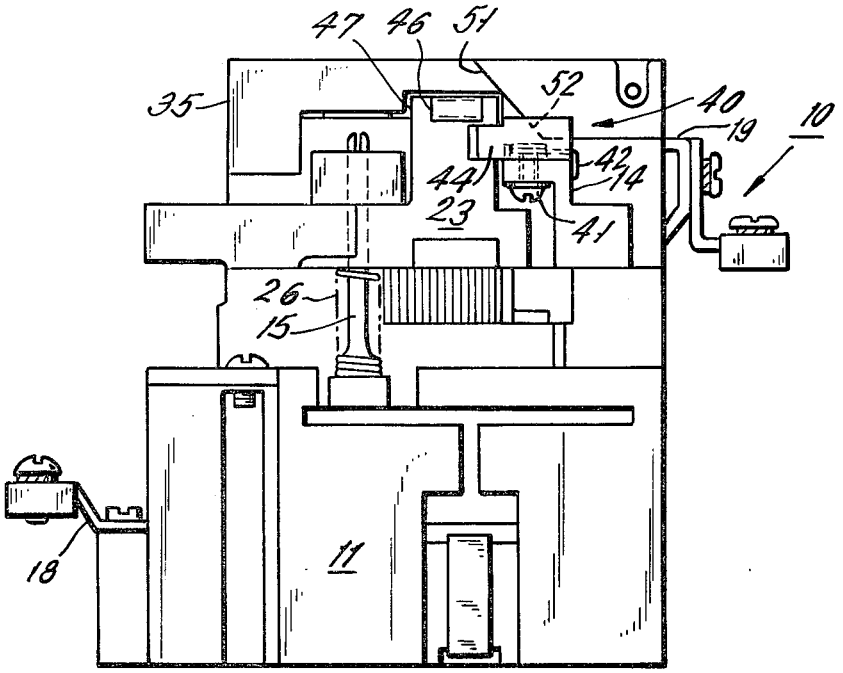
FIG. 1 is a side elevation of a contactor including contact interlock means constructed in accordance with the teachings of the instant invention.

Bridging contacts 30A, 30B, 30C are, with respect to FIG. 1, mounted in front of stationary contacts 21, 22 and are spaced therefrom when carrier 23 is in the raised or forward position when contactor 10 is open. When carrier 23 moves downward, the bridging contacts 30A, 30B, 30C each engage a seat of stationary contacts 21, 22 thereby closing the circuit between the line and load terminals 18, 19 of the particular phase. Removable cover 35, positioned above support plate 14 and secured thereto by two screws 39, encloses the area wherein the contacts 21, 22, 30 are disposed.

Switch interlock member 40 is a molded plastic element pivotally mounted to stationary contact support or carrier 14 by screw 41. Torsion spring 42, having one end disposed in rear slot 43 of interlock member 40 and the other end bearing against stationary contact carrier 14, biases member 40 clockwise with respect to FIGS. 2 and 3 toward the blocking position of FIG. 3. In this latter position projection 44 of member 40 is disposed behind sideways projection 46 of movable carrier guide formation 47. Thus, if the operating coil of contactor 10 is energized when cover 35 is off, the engagement of projection 46 with projection 44 will prevent rearward movement (movement in the contact closing direction) of movable contact carrier 23.

Figure 3:
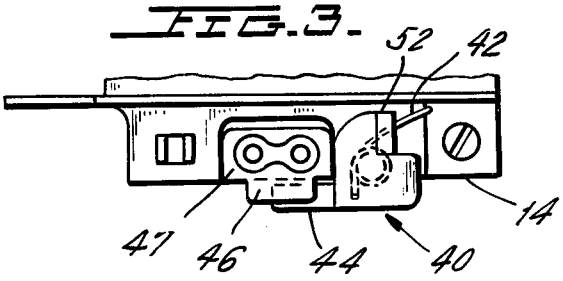
FIG. 3 is a fragmentary plan view with the cover removed to show the interlock member in its blocking position.
Figure 5:
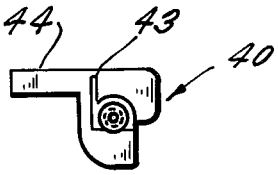
FIG. 5 is a rear elevation of the pivoted interlock member.
Figure 4:
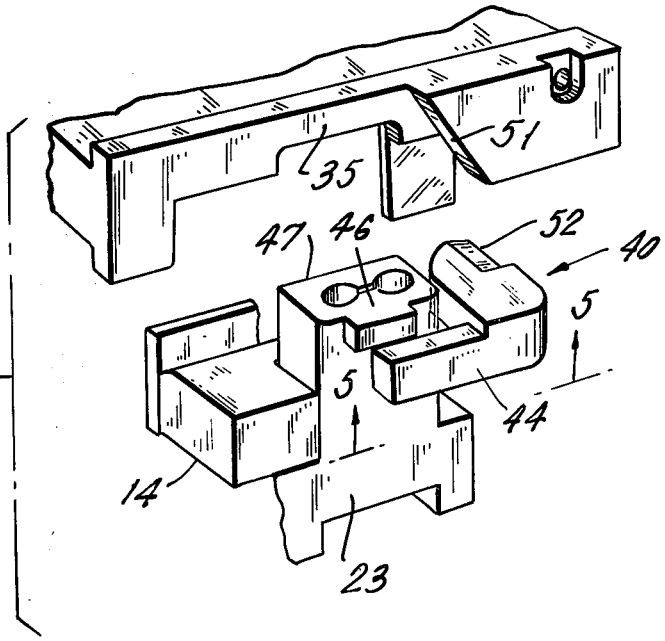
FIG. 4 is an exploded perspective of the cover and the interlock elements.

When cover 35 is placed in operative position in front of the contact area and secured in closed position by screws 39, inclined cam surface 51 on cover 35 engages complementary inclined cam surface 52 on interlock member 40 forcing the latter to pivot counterclockwise with respect to FIG. 3 to the position of FIG. 2. In this latter position projection 44 is outboard of projection 46, and these projections 44, 46 are no longer in a blocking relationship thereby permitting movable contact carrier 23 to be operated rearward to closed circuit position. When cover 35 is removed, torsion spring 42 automatically operates inerlock member 40 to its blocking position shown in FIG. 3.

Although there has been described a preferred embodiment of this invention, many variations and modifications will now be apparent to those skilled in the art. Therefore, this invention is to be limited, not by the specific disclosure herein, but only by the appended claims.

What is claimed is:

1. An electrical switching device including stationary contact means, movable contact means operable into and out of engagement with said stationary contact means, a stationary support means to which said stationary contact means is mounted, carrier means to which said movable contact means is mounted, means for guiding movement of said carrier means along a predetermined path relative to said support means between a contact closed and a contact open position, openable cover means cooperating with portions of said support means to enclose said stationary and said movable contact means, interlock means including a molded plastic member mounted to said support means and movable between a first and a second position, said member when in said first position being clear of said path and when in said second position having a portion thereof in said path, said interlock means also including biasing means automatically operating said member to said second position when said cover is open thereby blocking movement of said carrier means to said contact closed position, said cover means upon securement thereof in closed position engaging said member and operating the latter to said first position, means defining a pivot extending parallel to said path, said member pivoting about said pivot in moving between said first and second positions.

2. An electrical switching device as set forth in claim 1 in which the biasing means includes a torsion spring.

3. An electrical switching device as set forth in claim 1 in which the member is cammed to said first position by enegaging inclined planar surfaces formed integrally with said member and said cover, respectively.

4. An electrical switching device as set forth in claim 3 in which the inclined surfaces are complementary to each other.

5. An electrical switching device as set forth in claim 4 in which the biasing means includes a torsion spring.

* * * * *